US005715562A

United States Patent [19]

Lowrey et al.

[11] Patent Number: 5,715,562

[45] Date of Patent: Feb. 10, 1998

[54] ANGLE-RITE ADJUSTABLE PAINT ROLLER

[76] Inventors: Roland E. Lowrey, 1475 Grove Ave., Upland, Calif. 91786; James M. Guest, 5 Wilderness Pl., Pomona, Calif. 91766

[21] Appl. No.: 672,650

[22] Filed: Jun. 28, 1996

[51] Int. Cl.[6] ..... B05C 17/02

[52] U.S. Cl. ..... 15/230.11; 15/144.1; 492/13

[58] Field of Search ..... 15/144.1, 230.11; 492/13; 403/84, 87, 110

[56] References Cited

U.S. PATENT DOCUMENTS

| | | | |
|---|---|---|---|
| 2,824,328 | 2/1958 | Bedford . | |
| 3,027,582 | 4/1962 | Pittman . | |
| 3,044,094 | 7/1962 | Ecker . | |
| 3,273,192 | 9/1966 | Mazzella | 15/230.11 |
| 3,408,676 | 11/1968 | Cayo | 15/230.11 |
| 3,419,931 | 1/1969 | Willig | 15/144.1 |
| 4,528,714 | 7/1985 | Beck | 15/230.11 |
| 5,207,755 | 5/1993 | Ampain . | |

FOREIGN PATENT DOCUMENTS

| | | | |
|---|---|---|---|
| 1190520 | 7/1985 | Canada | 15/230.11 |

*Primary Examiner*—Randall Chin

[57] ABSTRACT

A paint device with a pivotal frictionally held connection mating the U shaped shaft portion with a cover to the handle and handle shaft portion. The pivotal mechanism is comprised of a threaded stud sufficient in length to passes through holes centered in the flattened ends of the handle shaft portion and the mating U shaped shaft portion, a nylon washer separating the two (2) shaft portions, a nylon and a steel washer set atop the installed U shaped shaft portion, and a locknut which caps the stud securing all components together. The locknut is torqued sufficient to establishes a friction on the components to hold the two (2) portions at any angle of choice chosen by the user of the device until changed by manual pressure applied by hand on either or both shaft portions sufficient to overcome the preset torque friction or by applying pressure on the handle shaft portion while the roller cover is pressed against a mating surface. The nylon washers enable this change in angle to be made, enable the angle to be held frictionally in-place, and prevent clogging or locking up of the pivotal components/connection.

6 Claims, 4 Drawing Sheets

PAINTING THE FACIA BOARD OF A HOUSE

PAINTING THE WALL ABOVE DOORWAY

PAINTING THE WALL WITH SLOPED CEILING

PAINTING A SLOPED CEILING

ANGLE-RITE ADJUSTABLE PAINT ROLLER

BACKGROUND OF THE INVENTION

1. Field of the Invention

This application pertains to an angularly adjustable paint roller for the application of paint or other coating materials to a surface for the expressed purpose of protecting, decorating and the like.

2. Description of Prior Art

Commercially available paint rollers consist of a one-piece angular roller frame shaft which connects a handle at one end and a roller cover horizontal to the handle at the other end. The roller frame shaft, cover and handle comprise a standard one piece paint roller that is non adjustable. Difficulty is often experienced when trying to apply coating materials to angular surfaces or where obstacles are present using this standard art device. Various attempts have been made over the past several years to modify the construction of the fixed paint roller frame to make it adjustable so as to make it easier to paint angled surfaces, such as exterior facia boards, gabled roofs, dormers, over and around door casings, windows, ceilings, and multi-angled vaulted ceilings to paint behind furniture or other areas not accessible, all without the need of body elevation aids such as ladders and scaffolding.

None of the previously adjustable paint rollers or art device modifications have satisfactorily solved these painting challenges. The basic problem with these prior art devices is that they have to be set and held at a fixed predetermined angle which can only be changed by loosening, moving and retightening the adjustment mechanism components. The prior art pivotal devices also have a tendency to loosen while applying the coating material. Additionally, the roller itself can only be held securely or flat against the mating surface at a minimal angular distance from the person applying the coating material. The designs of the prior art devices also make them expensive to manufacture compared to the standard non-adjustable roller frames. Most importantly, none of the prior art devices are capable of being adjusted while in motion during the application process whether it be to a horizontal, vertical or transaxial surface.

SUMMARY OF THE INVENTION

The above noted disadvantages are overcome by the preferred embodiments of this new paint roller frame which has its pivotal adjustment at the first bend in the shaft just above the handle. The adjustment mechanism is designed to hold the handle shaft portion and the U shaped shaft portion at any desired angular position. The mechanism is capable of allowing the position to be changed by the person applying the coating material by exerting pressure on the handle shaft portion while the roller cover is against the mating surface and then moving the handle shaft portion to the new desired angular position. The position of these two (2) portions can also be changed by moving one of the two (2) shaft portions by hand. The tension on the pivotal components comprising this adjustment mechanism is preset so as to hold it firmly in-placed without loosening during application of the coating material yet the tension can be overcome allowing angular movement through the exertion of pressure as just described. The use of a threaded stud, steel washer, nylon washers and a locknut give this adjustment mechanism this noted capability.

The uniqueness of this design circumvents the need to loosen, retighten, disassemble and reassemble the pivotal adjustment components in order to change or reset the roller cover to a new angle of choice. The pivotal design allows the roller cover to be positioned at any angle within the rotation circumference even perpendicular to either side of the handle. This provides maximum angular flexibility not found in prior are devices.

The components comprising this adjustment mechanism are standard off-the-shelf parts. The reconfiguration of the paint roller into two (2) portions makes it simple to manufacture.

BRIEF DESCRIPTION OF DRAWINGS

FIG. 2 is a side view of the invention's pivotal adjustment components which shows the flattened ends of the mating portions with a hole drilled or punched in the center large enough to allow the stud to pass through.

FIG. 4*a* depicts an angular adjustment position for painting a facia board on a house or building.

FIG. 4*b* shows an angular adjustment position for painting above a door jam in a house or building.

FIG. 4*c* shows the angular adjustment position for painting a wall that intersects with a sloped ceiling.

FIG. 4*d* shows the angular adjustment position for painting a sloped ceiling.

Reference Numerals in Drawings

Figure 1:
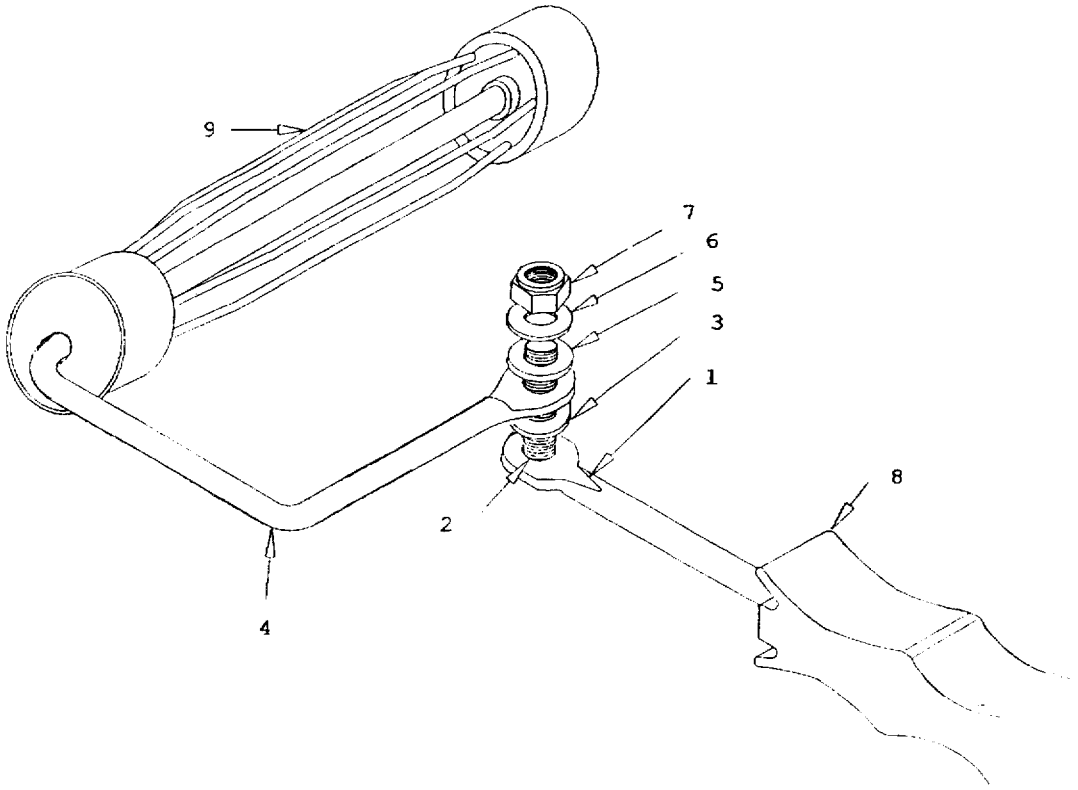
FIG. 1 depicts the front view of the invention showing the pivotal adjustment located where the paint roller handle shaft portion and the U shaped shaft portion connect.

1 Handle shaft
2 Threaded stud
3 Nylon washer
4 U shaped shaft
5 Nylon washer
6 Steel washer
7 Locknut
8 Roller handle
9 Roller cage/cover

DESCRIPTION OF THE PREFERRED EMBODIMENT(S)

Referring now to the drawings, and firstly to FIG. 1, the invention is shown generally at numerals 2, 3, 5, 6, and 7. These are the preferred materials for use in the adjustment mechanism. When installed with numerals (4) and (9) and (8) and (1), they comprise the new art device.

Figure 2:
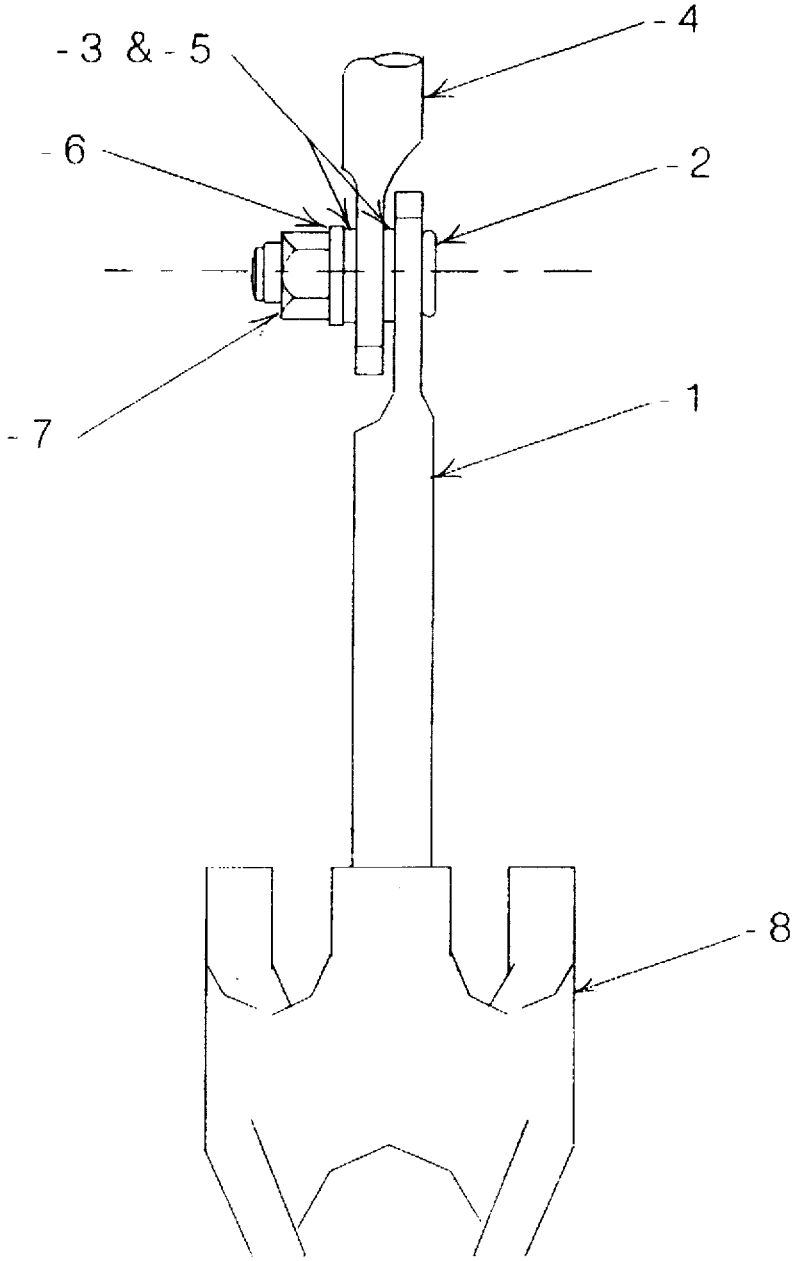

As shown in FIG. 1 and FIG. 2, the adjustment mechanism includes a threaded stud (2) that is installed through a hole that is drilled or punched in the flattened end of the handle shaft (1). The hole is large enough to allow penetration of the stud (2). A nylon washer (3) is then placed over the protruding portion of the stud (2). Next, the U shaped shaft (4), with the hole in the center of the flattened end, is placed over the protruding portion of the stud. A nylon washer (5) and a steel washer (6) are placed over the remaining portion of the protruding stud (2) which is then capped by a locknut (7) securing all components together.

The locknut (7) is tightened so as to put friction on the pivotal adjustment pieces and both shaft members portions (1) and (4). This tension holds the angular position of the roller in-place for the coating material application process. The nylon washers permit movement of the shaft members portions so that the angle of choice can be easily reset. This is accomplished by applying pressure on the roller handle (8) while the roller cover (9) is pressed against the surface to be painted and then moving the roller handle (8) to either side to obtain the desired angle of choice. This same action can be accomplished while moving the roller cover (9) over a surface thereby making the roller adjustable while in motion or use. Adjustment can also be made by manipulating the shaft member portions by hand.

Figure 3:
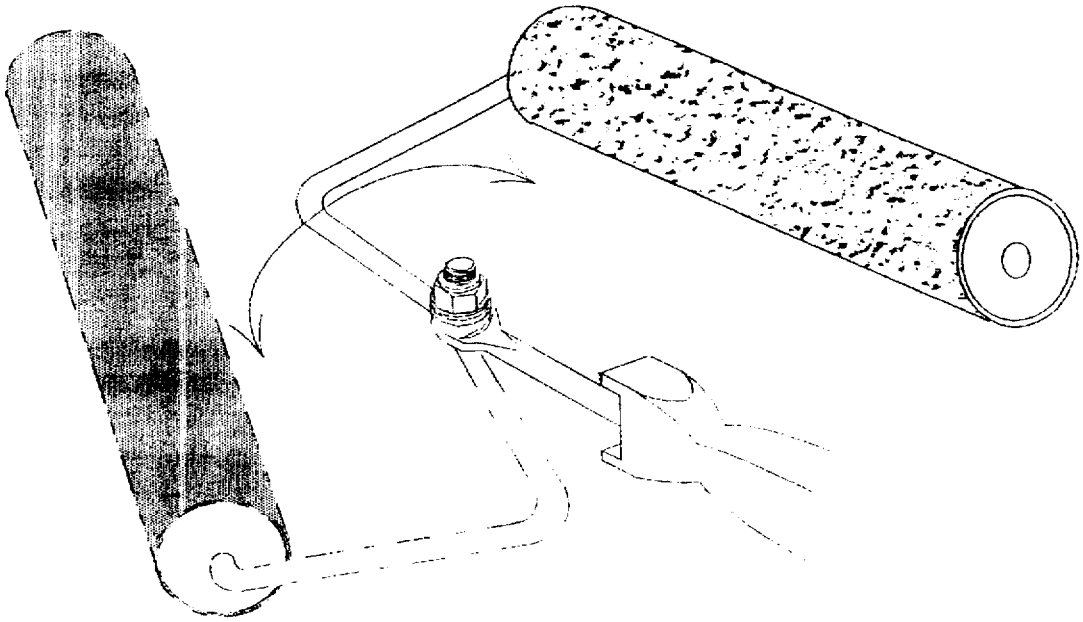
FIG. 3 shows the adjustment mechanism's pivotal rotation capability.
Figure 4A:
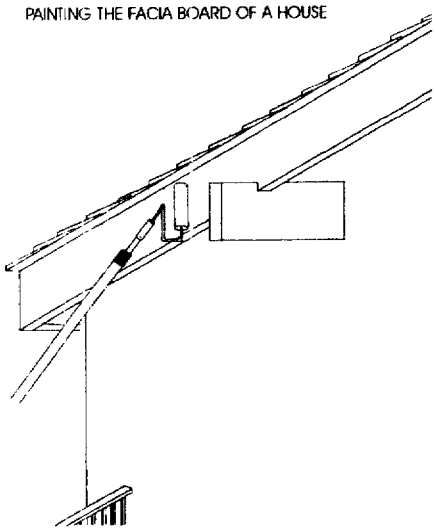
FIGS. 4*a*–4*d* depicts four (4) of several possible common angular adaptations that the adjustable paint roller may be used to paint or apply other type coating materials on to horizontal, vertical or trans-axial interior or exterior surfaces.
Figure 4B:
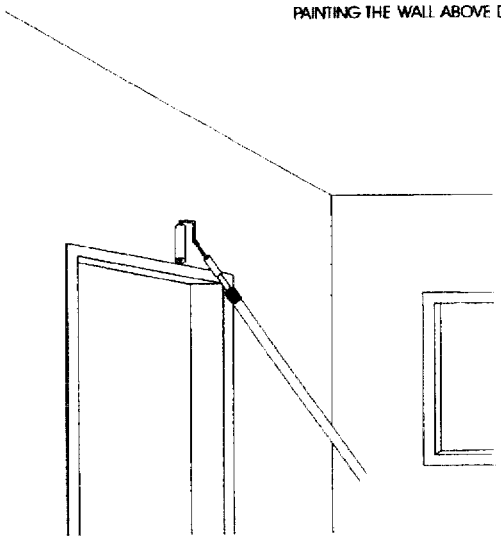
Figure 4C:
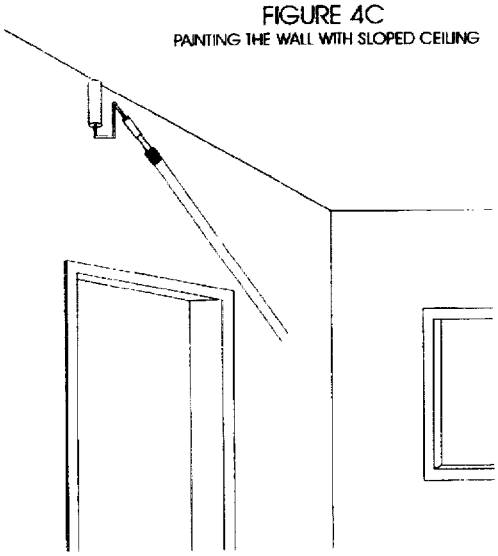
Figure 4D:
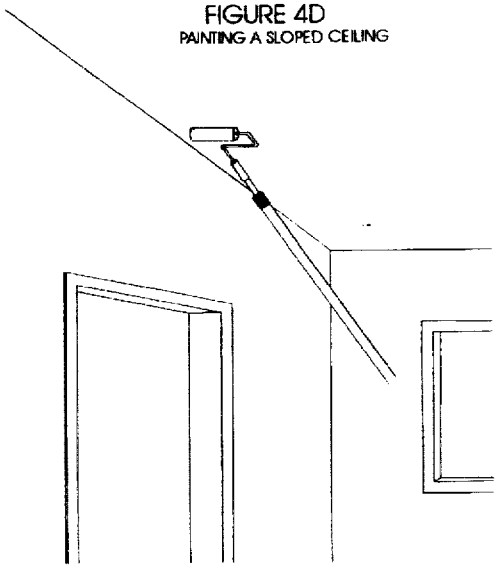

The orientation of the roller shaft (4) and roller cover (9) can be articulated back and forth to any desired angle as shown in FIG. 3. Thus, the roller cover (9) can be adjusted to any angular position up to being perpendicular to either side of the roller handle and handle shaft portion.

The locknut (7) can be tightened or loosened to obtain any desired tension by the user. Once a particular tension is chosen, the locknut (7) will not loosen at that friction tightness even after repeated pivoting of the shaft member portions. The adjustment mechanism will not clog with coating material or lock up.

FIG. 4, which is comprised of FIGS. 4*a*, 4*b*, 4*c* and 4*d*, shows four (4) of the various angles at which the roller cover (9) can be positioned and used with or without the depicted extension pole. The applicator is able to reach and paint many of these higher areas, without the use of ladders or scaffolding or other type body elevation aids, by installing an extension pole to the roller handle (8). The extension pole and the adjustable features of this paint device allow the applicator to more easily reach various heights from floor level, to get into potential inaccessible areas, or to paint behind obstacles that have minimal accessibility. These tasks are made even easier because the roller assembly angularity can be adjusted while the roller cover (9) is being moved across the surface.

The invention shown and described herein reflects the most practical and preferred embodiments. It is recognized that departures may be made from within the scope of the invention, which is, therefore, not to be limited to the details disclosed herein, but is to be afforded the full scope of the claims so as to embrace any and all equivalent apparatuses and articles.

What is claimed is:

1. A paint roller device comprising:

a first portion consisting of a handle and a handle shaft, the handle shaft having two ends, one of said ends connected to the handle and the other of said ends of said handle shaft having a flattened end with a pressed-in threaded stud protruding from a center of said flattened end;

a second portion consisting of a U-shaped shaft having two ends, one end of said U-shaped shaft having a roller cage and cover and the other of said ends of said U-shaped shaft having a flattened end with a hole defined therethrough for fitting over the threaded stud;

a nylon washer placed over the stud and being positioned between the first portion and second portion;

a nylon washer and a steel washer placed over the threaded stud above the second portion; and a locknut capping the threaded stud to secure the device together wherein the threaded stud, nylon washers, steel washer and locknut define a pivotal adjustment mechanism whereby the second portion can be pivotally adjusted with respect to the first portion at an angle of choice.

2. The paint roller device of claim 1 wherein the nylon washer positioned between the first portion and second portion enables the flattened ends to move smoothly over the surface of the nylon washer for pivotal movement.

3. The paint roller device of claim 1 wherein the locknut can be torqued to set friction on the first portion and the second portion sufficient to hold the first portion and the second portion in place at an angle of choice.

4. The paint roller of claim 1 wherein the pivotal adjustment mechanism permits pivotal movement of said second portion such that a longitudinal axis of the roller cage and cover is parallel with a longitudinal axis of the handle.

5. The paint roller device of claim 1 wherein the handle can be connected to an extension pole to reach various heights.

6. The paint roller device of claim 1 wherein the angle of choice can be set without loosening, re-tightening, disassembling or re-assembling the pivotal adjustment mechanism.

* * * * *